US006010814A

United States Patent [19]

Kotsugai et al.

[11] Patent Number: 6,010,814

[45] Date of Patent: Jan. 4, 2000

[54] ELECTROPHOTOGRAPHIC TONER COMPOSITION AND IMAGE FORMATION METHOD USING THE COMPOSITION

[75] Inventors: Akihiro Kotsugai, Numazu; Masanori Suzuki, Sunto-gun, both of Japan

[73] Assignee: Ricoh Company, Ltd., Tokyo, Japan

[21] Appl. No.: 09/178,583

[22] Filed: Oct. 26, 1998

[30] Foreign Application Priority Data

Oct. 27, 1997 [JP] Japan ..... 9-309433

[51] Int. Cl.[7] ..... G03G 9/097

[52] U.S. Cl. ..... 430/110; 430/111

[58] Field of Search ..... 430/110, 111

[56] References Cited

U.S. PATENT DOCUMENTS 5,272,040 12/1993 Nakasawa et al. ..... 430/111

OTHER PUBLICATIONS

Japanese Laid–Open Patent Application No. 59–46664, Mar. 16, 1984, Transfer Roll for Use in Copying Machine.

Japanese Laid–Open Patent Application No. 60–238847, Nov. 27, 1985, Electrostatic Image Developing Toner and its Preparation.

Japanese Laid–Open Patent Application No. 61–147261, Jul. 4, 1986, Electrostatic Charge Image Developing Charge Donor.

Patent Abstracts of Japan, 07056380 A, Mar. 3, 1995, Toner.

Patent Abstracts of Japan, 07230179 A, Aug. 29, 1995, Electrophotographic Toner Composition.

JP 52–30437—Abstract.

*Primary Examiner*—Roland Martin

*Attorney, Agent, or Firm*—Oblon, Spivak, McClelland, Maier

[57] ABSTRACT

An electrophotographic toner composition is disclosed, including toner particles containing a coloring agent, a binder resin and at least two kinds of additives, wherein these additives satisfy the relationship, $4<((\in_H-\in_L)/0.75+\log(f))<16$, in which f in Hz corresponds to a 1 kHz frequency used for the present dielectric constant measurements, and $\in_H$ and $\in_L$ are respectively highest and lowest values of dielectric constants obtained at 1 kHz for the additives.

9 Claims, No Drawings

ELECTROPHOTOGRAPHIC TONER COMPOSITION AND IMAGE FORMATION METHOD USING THE COMPOSITION

BACKGROUND OF THE INVENTION

1. Field of the Invention

The present invention relates to an electrophotographic toner composition for developing an electrostatic latent image in electrophotography or electrostatic printing. The present invention also relates to a method of producing the toner.

2. Discussion of Background

In electrophotography or electrostatic printing based on the Carlson process, electrophotographic developers are generally employed for visualizing an electrostatic latent image. These developers are broadly divided into two groups. In one group are two-component developers which are each composed of a toner and a carrier admixed such that an appropriate electrostatic charging is attained by donating charges onto the toner, as disclosed in Japanese Laid-Open Patent Application (referred to hereinafter as JPA) No. 61-147261, for example. In the other group are one-component developers which are each composed of a toner, and with which charging is carried out on a roller for supplying toner in a developing sleeve portion by transferring charges from a blade.

The toners are prepared as minute particles, including either synthetic or natural thermoplastic resin as a major component, in which is dispersed coloring agents such as carbon black or dye material. The toner particles are generally provided with a variety of additive agents to achieve proper and stable charging characteristics durable for a prolonged period of time.

Since two-component developers are electrostatically charged by transferring charges onto the toner, as described earlier, it is of major importance for the toner to retain a stable and predetermined amount of charge throughout imaging processes, to thereby achieve and also to retain reliable and durable imaging capabilities. In addition, since the charging is achieved in the two-component developers typically through triboelectric effects induced by the collision and friction between toner particles, charging is affected primarily by the balance between the charging and charge retaining capabilities of the toner particle. It has been known that this balance between charging and charge retaining is largely dictated by the dielectric properties of toner particles.

As requirements for electrophotographic images with more minute and more reproducible features have increased, the need for toners with greater fluidity has also increased. Several attempts to improve toner fluidity are known, such as by the addition of hydrophobic fine powders, as disclosed in JPA-52-30437 and 60-238847. However, when hydrophobic powders are added to toner in amounts sufficient to achieve desired toner fluidity characteristics, these hydrophobic powders adversely affect the stability of the charging property of the toner. In addition, as the size of the toner particles decreases, the amount of hydrophobic powders that must be added to the toner increases, in general.

Furthermore, in place of the prior method of charging, in which the charging of a photoreceptor is carried out through a corona discharge induced by high voltages applied to a metal wire, an alternative method has been attracting attention. In this alternative method, an image bearing member such as a photoreceptor is brought into close contact with an image forming member such as an image transfer sheet or copy sheet, and the charging is then carried out using an electrode which is in contact with a transferring member, to thereby induce a voltage potential therebetween. Since the latter method is able to transfer toner particles by pressure as well as the voltage potential, this method gives rise to a decrease in the amount of ozone generated during the toner transfer process, which is preferable over prior methods.

One of the shortcomings of the latter method is that the minute line images formed by the method contain missing portions. Although this shortcoming can be obviated to some extent by the use of fluid toner particles, a relatively large amount of additive agents is generally required, often resulting in a decrease in durability of toner charging capability and also in image quality caused by an increase in the amount of charge with time elapsed. Toner particles characterized by the addition of these additive agents are disclosed in JPA-7-56380 and 7-230179, for example, which use titanium oxide particles which are surface treated with hydrophobic agents such as silane, silica or silicone compounds. These surface treated titanium oxide particles, however, are not as satisfactory as hydrophobic silica particles in solving the above-noted difficulty encountered in the improvement of the toner fluidity. In addition, these surface treated particles, in general, may result in the decrease in charging capability caused by high dielectric and low resistivity properties of toner particles themselves.

SUMMARY OF THE INVENTION

Accordingly, one object of the present invention is to provide an electrophotographic toner composition which overcomes the above-noted difficulties.

A further object of the present invention is to provide an electrophotographic toner composition having excellent durable capabilities of electrostatic charging and image formation with a high and persistent image density.

Another object of the present invention is to provide an electrophotographic toner composition having capabilities of forming electrophotographic images with minute line images of a high resolution without missing image dots.

These and other objects of the present invention have been satisfied by providing an electrophotographic toner composition, including toner particles containing a coloring agent, a binder resin, and at least two kinds of additives, wherein the at least two kinds of the additives satisfy the relationship, $$4<((\in_H-\in_L)/0.75+\log(f))<16,$$

in which f in Hz is a 1 kHz frequency for the present AC impedance measurements, and $\in_H$ and $\in_L$ are respectively highest and lowest values of dielectric constants obtained from the measurements at 1 kHz for the additives.

In another aspect of the present invention, the electrophotographic toner composition is characterized by such a dielectric property as specified by the relationship, $$5<(\in_B/0.75+\log(f))<11,$$

in which f in Hz is a 1 kHz frequency for the present impedance measurement, and $\in_B$ is a dielectric constant obtained from the measurement at 1 kHz for the toner composition.

In still another aspect of the present invention, the electrophotographic toner composition includes toner particles containing a coloring agent, a binder resin, and at least two kinds of additives. These additives are composed of the mixture of the particles of hydrophobic titanium oxide and hydrophobic silicon oxide, and the mixture is characterized by a dielectric constant at 1 kHz of from 2 to 6. In addition, the surface of the particles of hydrophobic titanium oxide is substantially coated with compounds represented by the following general formula, $$(C_nF_{2n+1})_p—(Si—(O—C_mF_{2m+1}))_{4-p},$$

or with polycondensation products thereof, in which n and m are each a positive integer equal to or larger than 4. Furthermore, the at least two kind of the additives are each characterized by volume resistivity values ranging from $1\times10^8$ to $1\times10^{10}$ ohm.cm and by a ratio Dn/Dv of equal to or less than 2, in which Dn and Dv are number average and volume average particle sizes, respectively, and the content of these additives in the toner composition is from 0.1 to 2% by weight and the number average particle size of the additives is from 5 to 10 microns.

The present invention also relates to a method for forming an electrophotographic image including at least a charging process in which a carrier for a latent image is charged; a latent image forming process in which an electrostatic latent image is formed on the charged carrier for a latent image; and a developing process in which the electrostatic latent image is developed with the electrophotographic toner composition described hereinabove.

These and other objects, features and advantages of the present invention will become apparent upon a consideration of the following description of the preferred embodiments of the invention.

DESCRIPTION OF THE PREFERRED EMBODIMENTS

In the detailed description which follows, specific embodiments of the invention particularly useful in the electrophotographic image formation are described. It is understood, however, that the invention is not limited to these embodiments. For example, it is appreciated that the image developing toner composition and methods of this invention are also adaptable to any form of electrostatic image formation such as electrostatic printing and other similar processes. Other embodiments will be apparent to those skilled in the art upon reading the following description.

The invention provides an electrophotographic toner composition, including toner particles containing a coloring agent, a binder resin, at least two kinds of additives.

The present inventor has conducted extensive investigations of an electrophotographic toner composition and its electrical properties with an emphasis on additive agents. Since charging of toner particles is considerably affected by the electrical properties of additive agents coated on the surface of the toner particles, it is quite important for the additive agents to exhibit proper dielectric and electrical resistivity properties.

Especially in the present invention, a variety of additive agents, each of which has a different dielectric constant, are admixed and used as developing toner particles, such that the additives are characterized by a dielectric property specified by the relationship, $4<((\in_H-\in_L)/0.75+\log(f))<16$, in which f in Hz is a 1 kHz frequency for the present AC impedance measurements, and $\in_H$ and $\in_L$ are respectively highest and lowest values of dielectric constants obtained from the measurements at 1 kHz for the additives. An excellent charging stability is achieved in the present invention, as will be described hereinbelow.

When the above-mentioned value is less than 4, the surface of toner particles are considered to be covered substantially by materials (i.e., additive agents) having low dielectric constants. Owing to these low dielectric constants, or to a deficient charge exchange between the plurality of materials with low dielectric property, a gradual increase results in the amount of toner charge, resulting in a decrease in image density and durability.

When the above-mentioned value is larger than 16, by contrast, neither a sufficient amount of charge during the developing process nor a proper charge retaining capability is achieved, and several difficulties such as an unusual increase in image density or scumming (or dirty background) may result. In addition, a satisfactory image transfer capability can not be expected due to the above-noted insufficient charge retaining capability.

As indicated earlier, when an electrophotographic toner composition is formed in the present invention, which includes toner particles containing a coloring agent, a binder resin and at least two kinds of additives, and which is characterized as satisfying the relationship, $$5<(\in_B/0.75+\log(f))<11,$$

in which f is Hz is a 1 kHz frequency for AC impedance measurements, and EB is a dielectric constant obtained from the measurement at 1 kHz for the toner composition, an excellent charging capability has been attained.

Additive agents for improving fluidity of toners in the present invention include any of materials such as metal oxides, organic resins, metal soaps and similar other materials.

Illustrative examples of the additive agents include lubricants such as Teflon and zinc stearate, abrasives such as cerium oxide and silicon carbide, fluidity improving agents such as inorganic oxides like silicon dioxide and titanium oxide, which are made hydrophobic by surface treatment; anti-caking agents and other similar materials.

Although hydrophobic silica particles are particularly preferred for their excellent fluidity property, these particles have relatively high dielectric constants. Therefore, other particles of metal oxide such as titanium oxide, aluminum oxide and zirconium oxide are admixed with the above-mentioned silica particles and used as additive agents. These metal oxides also have excellent fluidity properties. By adjusting the dielectric and conductive properties of the particles utilizing appropriate surface treating agents and/or treating method therewith, and by using these particles in combination with particles of other additive agents, excellent charging capability and fluidity are achieved by the toner particles in the present invention relative to previous toner particles. These particles of additive agents including the admixture with other agents are hereinafter referred to as additive particulates.

Specific examples of such surface treating agents include methyltrimethoxysilane, hexamethyldisilazane, methyltrimethoxysilane, dimethylpolysiloxane, isobutyl trimethoxysilane, trimethoxyfluoropropylsilane and methyltrimethoxysilane.

Furthermore, when a plurality of additives are used as additive particulates, electrical properties of the particulates is important. To achieve satisfactory image quality, it is preferable that the additive particulates have a dielectric constant of from 2 to 6 at 1 kHz and a volume resistivity ranging from $1\times10^8$ to $1\times10^{10}$ ohm.cm.

Still further, to achieve a sufficient fluidity and thereby a high image quality, these particulates preferably have a number average particle size Dn ranging from 10 to 500 nanometers. In addition, the aggregation of the particulates may occur for a wide size distribution and may cause a decrease in image quality through their mixing into ordinary particulates, and thereby cause missing dots in resultant images. To avoid such aggregation, the additive particulates are characterized by a Dn/Dv ratio of equal to or less than 2, in which Dn is the number average particle size mentioned just above and Dv is a volume average particle size.

In addition, for the fluidity of the additive particulates to be effectively utilized, these particulates preferably have a particle size ranging from 5 to 10 microns and are included in the toner in a content of from 0.1 to 2% by weight.

Although the contents of the additive particulates further increases to achieve a sufficient fluidity for the toner particle size of less than 5 microns, this tends to give rise to a decrease in fixing capability and damage of the surface of a photoreceptor.

Although, by contrast, the content of the additive particulates for achieving a sufficient fluidity increases for the toner particle size of greater less than 10 microns, details of resultant images tend to be impaired.

Although a variety of additive agents may be selected among known hydrophobic compounds of metal oxide particles, as mentioned earlier, hydrophobic titanium oxide particles are found especially effective for achieving appropriate dielectric as well as conductive properties, when the surface of these particulates is surface treated and substantially coated with compounds represented by the following general formula, $$(C_nF_{2n+1})_p—(Si—(O—C_mF_{2m+1}))_{4-p},$$

or with polycondensation products thereof, in which n and m are each a positive integer equal to or larger than 4.

Specific examples for the above-mentioned surface treated titanium oxide particles include those surface treated to be made hydrophobic with trimethoxyfluoropropylsilane, and those treated with the admixture of trimethoxyfluoropropylsilane and methyltrimethoxysilane.

In the present invention, a toner composition includes toner particles containing a binder resin as a major component, a coloring agent, additive particulates, a charge controlling agent, a releasing agent and other similar materials. The toner composition may be prepared by known toner manufacturing methods including pulverization, polymerization and others.

The binder resins suitably used in the present invention include acrylic resins, polyester resins and epoxy resins, as follows.

Examples of the acrylic resins used in the present invention include polymers of styrene and derivatives thereof such as polystyrene and polyvinyltoluene; and styrene-copolymers such as styrene-p-chlorostyrene copolymer,
styrene-polypropylene copolymer,
styrene-vinyltoluene copolymer,
styrene-methylacrylate copolymer,
styrene-ethylacrylate copolymer,
styrene-butylacrylate copolymer,
styrene-α-methylchlormethacrylate copolymer,
styrene-acrylonitrile copolymer,
styrene-vinylmethylether copolymer,
styrene-vinylmethylketone copolymer,
styrene-butadiene copolymer,
styrene-isoprene copolymer,
styrene-maleic acid copolymer, and
styrene-maleate copolymer;
polymethylmethacylate,
polybutylmethacylate,
polyvinylchloride,
polyvinylacetate,
polyethylene,
polypropylene,
polyester,
polyurethane,
epoxy resins,
polyvinylbutyral,
polyacrylic resins,
rosin,
modified rosin,
terpene resins,
phenol resins,
aliphatic resins,
aliphatic hydrocarbon resins,
aromatic petroleum resins,
chlorinated paraffin, and
paraffin wax.

These materials may be used individually or in combination.

The polyester resins used in the present invention may be formed through known polycondensation reactions of alcohol and acid.

Examples of the alcohol include: diols such as polyethylene glycol,
diethylene glycol,
triethylene glycol
1,2-propylene glycol,
1,3-propylene glycol,
1,4-propylene glycol,
neopentyl glycol, and 1,4-butenediole;
bisphenol A etherificated such as
1,4-bis(hydroxymethyl)cyclohexane,
hydrogenated bisphenol A,
bis(polyoxyethylene phenyl)propane,
bis(polyoxymethylene phenyl)propane;

dihydric alcohol monomers formed by the substitution thereof with a saturated or unsaturated hydrocarbon group having 3–22 carbon atoms, and other dihydric alcohol monomers;
trihydric or higher alcohol monomers such as sorbitol,
1,2,3,6-hexane tetrol,
1,4-sorbitan,
pentaerythritol,
dipentaerythritol,
tripentaerythritol,
cane sugar,
1,2,4-butanetriole,
1,2,5-pentanetriole,
glycerol,
2-methyl propanetriole,
2-metyl-1,2,4-butanetriole,
trimetylolethane,
trimetylolpropane, and
1,3,5-trihydroxymethylbenzene.

Examples of the carboxylic acid used in the present invention include:

monocarboxylic acid such as
palmitic acid,
stearic acid, and
oleic acid;
dibasic organic acid monomers such as
maleic acid,
fumalic acid,
mesaconic acid,
citraconic acid,
terephthalic acid, cylclohexane dicarboxycylic acid,
succinic acid,
adipic acid,
sebatic acid,
malonic acid,
dibasic acid monomers formed by the substitution thereof with a saturated or unsaturated hydrocarbon group having 3–22 carbon atoms,
anhydrides thereof, and
a dimer formed between low alkylester and linoleic acid;
tribasic or higher acid monomers such as
1,2,4-benzenetricarboxylic acid,
1,2,5-benzenetricarboxylic acid,
2,5,7-naphthalenetricarboxylic acid,
1,2,4-naphthalenetricarboxylic acid,
1,2,4-butanetricarboxylic acid,
1,2,5-hexanetricarboxylic acid,
1,3-dicarboxyl-2-methyl-2-methylene carboxypropane, and
tetra(methylenecarboxyl)methane, and anhydrides thereof.

Examples of the epoxy resins used in the present invention include polycondensation products between bisphenol A and epochlorohydrin, which are commercially available as Epomick R362, R364, R365, R366, R367 and R369 from Mitsui Petrochemical Co. Japan; YD-011, YD-012, YD-014, YD-904 and YD-017 from Toto Chemical Co. Japan; and Epocoat 1002, 1004 and 1007 from Shell Chemical Japan Co.

Suitable materials for the coloring agents in the present invention include but are not limited to carbon black, lamp black, iron black, ultramarine, nigrosine, aniline blue, phthalocyanine blue, Hansa Yellow G, Rhodamine 6G, lake, chalcone blue, Chrome Yellow, quinacridone, Benzidine Yellow, Rose Bengale, triallylmethane dyes, mono-azo or diazo pigments, and other known dyes and pigments. These materials may be used individually or in combination.

A toner composition of the present invention may also include such additional materials as charge (or frictional charge) controlling agents which are generally included in known toner materials.

Specific examples of the charge controlling agents includes polarity controlling agents such as metal complexes of mono-azo dye, nitrohumic acid and salts thereof, amino compounds of Co, Cr, or Fe metal complexes with salicylic acid, naphthoic acid or dicarboxylic acid; quarternary ammonium compounds and organic dye materials.

Toner compositions of the present invention may also include releasing agents, when relevant. Examples of the releasing agents include, but not limited to low molecular weight polypropylene, low molecular weight polyethylene, carnauba wax, micro-crystalline wax, jojoba wax, rice wax and montan wax. These materials may be used individually or in combination.

In a toner composition in the present invention, the contents (% by weight) of respective materials included are preferably from 75 to 93 of a binder resin, from 3 to 10 of a coloring agent, from 0.1 to 3 of additive particulates and from 1 to 7 of other materials.

The toner composition of the present invention may be used singly (i.e., without carriers) as a single-component developer. Also the toner composition is admixed with carriers so as to be used as a two-component developer as well.

As the carriers used in this invention, there may preferably be used a variety of known carrier materials such as, for example, magnetic powders composed of iron, ferrite or nickel; and glass beads. The surface of these materials may also be coated with resin such as, for example, silicone resin. As the silicone resin, any of known silicon resins may be used in the present invention.

In addition, any of known coating methods, including spraying and dipping, may preferably be used for coating these carriers with silicone resins. In silicone coating compositions used for the coating, there may preferably be added a variety of additives. Examples of these additives include the aforementioned organic of inorganic materials like conductive particles and charge controlling agents such as, for example, dyes, pigments, magnetic materials or conductive materials. These materials may be added to the composition individually or in combination.

Furthermore, at least one silane coupling agent may also be added in the silicone coating composition to improve dispersibility and solubility between the additive and silicone resin.

The silane coupling agents for use in the present invention are expressed by the following general formula:

$$X—Si(OR)_n$$

wherein X is either a functional group which is reactive or adsorbent to either organic or inorganic materials, or a saturated or unsaturated hydrocarbon chain with such a functional group as described above; OR is an alkoxy group and the number n is an integer of from 1 to 3. As the silane coupling agent, an amino silane coupling agent having an amino group as the X group is preferably used in the present invention.

When the toner materials are admixed with carriers and utilized as two-component developers, the exact number of the mixing ratio between carriers and toners may vary, of course, depending on either average size or density of these particles. In general, the ratio of the toners and carriers is preferably 100 parts by weight for the former to from 0.5 to 15.0 parts by weight for the latter.

EXAMPLES

Having generally described this invention, a further understanding can be obtained by reference to a specific example which is provided herein for purposes of illustration only and are not intended to be limiting.

Although two kinds of additive particulates (A and B) for improving the toner fluidity are mentioned in the following examples, more than two kinds of additive particulates may also be used in the present invention.

In the description of the following examples, numerals are parts by weight unless otherwise indicated. The size of toner particles were measured with a Coulter Counter from Coulter Electronics Ltd. UK.

A plurality of electrophotographic toner compositions of the present invention were produced as follows.

Starting Toner, Particles 1

Starting toner particles 1 for the developing toners were prepared by thoroughly mixing the following components:

| | |
|---|---|
| Polyester resin | 70 |
| Styrene acrylic resin | 15 |
| Carnauba wax | 5 |
| Carbon black | 10 |
| Dielectric metal salycilate | 3 |

The mixed components were then melted and milled with a two-roller kneader to obtain slabs. The slabs were then pulverized with a cutter mill, jetted using high speed airflow, and classified with an air classifier to obtain starting toner particles 1, having a volume average particle size of 12.0 microns.

Starting Toner Particles 2

Starting toner particles 2 were prepared in a manner similar to that used to prepare the starting toner particles 1. In contrast to the particles 1, the particles 2 had a volume average particle size of 8.2 microns.

Additive Particulates for Improving Fluidity

In addition to the above stated starting toner particles, additive particulates, to aid in flow property of resulting toners, were prepared as follows.

First, a coupling agent "b" (Table 1) of such an amount as specified in column 5 in Table 1, was dissolved in toluene. Into the prepared toluene solution, fine particles "a" for forming core materials in an amount of 100 parts by weight were dispersed to form a slurry, then mixed for about 24 hours with a ball mill. The whole mixture was subsequently vacuum dried under thorough stirring and shearing to result in powders. The thus prepared powders were subsequently calcined at a temperature of from 100° C. to 300° C., then cooled and pulverized with a crusher, to thereby obtain additive particulates 1 through 7 for improving the fluidity of resulting toners.

Dielectric constant measurements of the thus prepared additive particulates were carried out as follows. The additive particulates were disposed in a cylindrical measurement cell which was composed of an insulator material and had an inner diameter of about 2 cm, such that the particulates were filled between a pair of conductive metal electrodes which were disposed opposing to each other with a distance thereof from 0.5 to 1.0 millimeter. Incorporating the measurement cell filled with the particulates, a bridge circuit for AC impedance measurements was formed, and a dielectric constant at 25° C. in the air was measured at 1 kHz. The results of the measurements are shown in Table 1 for each of the additive particulates 1 thorough 7.

TABLE 1

| Additive particulate No. | Core material a | Coupling agents b | Dielectric constant $\epsilon$ | Amount of coupling agent |
|---|---|---|---|---|
| 1 | Silica | Methyltrimethoxysilane Hexamethyldisilazane | 2.1 | 10 |
| 2 | Silica | Methyltrimethoxysilane | 2.0 | 10 |
| 3 | Titanium dioxide | Dimethylpolysiloxane | 10.5 | 1 |
| 4 | Titanium dioxide | Isobutyl trimethoxy-silane | 8.4 | 10 |
| 5 | Titanium dioxide | Isobutyl trimethoxy-silane | 3.2 | 20 |
| 6 | Titanium dioxide | Mixture of trimethoxy-fluoropropylsilane and methyltrimethoxysilane | 7.5 | 10(5:5) |
| 7 | Titanium dioxide | None | 35.0 | 0 |

Toner Composition

A plurality of toner compositions were produced as follows in accordance with the steps of the present invention.

First, into 100 parts by weight of the starting toner particle 1, two kind of the additive particulates A and B (in Table 2), were added with the amounts as respectively shown in Table 2, then mixed with a Henshel-type mixer for a predetermined period of time, and sieved with 200 micron meshes to remove particles with larger sizes, whereby toner compositions 1 through 5 were formed.

Second, other toner compositions 6 through 9 were formed in similar manner as above, with the exception that, prior to mixing with starting toner particle 2, additive particulates were removed of particulates having larger particle sizes by sieving, that was carried out to be consistent with the aforementioned smaller size (i.e., 8.2 microns) of the toner starting material 2.

Characteristics of the thus prepared plurality of mixtures of additive particulate were each measured as follows and results are shown also in Table 2.

Particle Size

An appropriate amount of toner particles are dispersed into a mixed solution of alcohol with water (1 to 1 by volume), then stirred slowly. After a pH adjustment is made, when relevant, upper (or supernatant) portions of the solution were collected and then subjected to a dynamic light scattering measurements with an Ohtsuka Model DLS700 apparatus to thereby obtain particle size with the Cumlant method.

Dielectric Constant and Volume Resistivity

In a similar manner to the aforementioned dielectric measurements of additive particulates, the mixtures were disposed in a cylindrical measurement cell which was composed of an insulator material and had an inner diameter of about 2 cm, such that the particulates were filled between a pair of conductive metal electrodes which were disposed opposing to each other with a distance thereof from 0.5 to 1.0 millimeter.

An impedance bridge for AC dielectric measurements was formed, incorporating the measurement cell filled with the particulates, and a dielectric constant at 25° C. in the air was measured at 1 kHz. The following a value was calculated using the relationship, $$(\in_H-\in_L)/0.75+\log(f)=\alpha$$

in which f in Hz is a 1 kHz frequency for the AC impedance measurements, and $\in_H$ and $\in_L$ are respectively highest and lowest values of dielectric constants obtained from the measurements at 1 kHz. For example, $\alpha$ in Table 2 for Toner 1 is calculated using $\in_H$=3.2 (corresponding to additive particulates B) and $\in_L$=2.1 (corresponding to additive particulates A).

TABLE 2

Combination of additive particulates to be included in toner compositions.

| Toner composition | Starting toner particles No. | Additive particulates A: Additive particulates used No. | Additive particulates A: Dielectric constant ∈ | Additive particulates A: Parts by weight | Additive particulates B: Additive particulates used No. | Additive particulates B: Dielectric constant ∈ | Additive particulates B: Parts by weight |
|---|---|---|---|---|---|---|---|
| Toner 1 | 1 | 1 | 2.1 | 0.5 | 5 | 3.2 | 0.05 |
| Toner 2 | 1 | 1 | 2.1 | 0.5 | 3 | 10.5 | 0.4 |
| Toner 3 | 1 | 1 | 2.1 | 0.5 | 5 | 3.2 | 0.4 |
| Toner 4 | 1 | 1 | 2.1 | 0.5 | 3 | 10.5 | 0.05 |
| Toner 5 | 1 | 1 | 2.1 | 0.7 | 4 | 8.4 | 0.3 |
| Toner 6 | 2 | 1 | 2.1 | 0.7 | 4 | 8.4 | 0.3 |
| Toner 7 | 2 | 1 | 2.1 | 0.7 | 6 | 7.5 | 0.3 |
| Toner 8 | 2 | 1 | 2.1 | 0.7 | 7 | 35.0 | 0.3 |
| Toner 9 | 2 | 1 | 2.1 | 0.7 | 2 | 2.0 | 0.3 |

| Toner composition | Starting toner particles No. | Dn/Dv | α | β | Dielectric constant of mixture $\in_B$ | Volume resistivity ohm · cm |
|---|---|---|---|---|---|---|
| Toner 1 | 1 | 2.2 | 4.5 | 5.4 | 1.8 | $3.1 \times 10^{10}$ |
| Toner 2 | 1 | 2.3 | 14.2 | 15.3 | 9.2 | $2.1 \times 10^{7}$ |
| Toner 3 | 1 | 2.1 | 4.5 | 5.7 | 2 | $2.8 \times 10^{10}$ |
| Toner 4 | 1 | 2.2 | 14.2 | 13.0 | 7.5 | $8.6 \times 10^{9}$ |
| Toner 5 | 1 | 1.2 | 11.4 | 8.3 | 4 | $9.3 \times 10^{9}$ |
| Toner 6 | 2 | 1.3 | 11.4 | 8.3 | 4 | $9.3 \times 10^{9}$ |
| Toner 7 | 2 | 1.2 | 10.2 | 8.3 | 4 | $8.1 \times 10^{9}$ |
| Toner 8 | 2 | 1.2 | 46.9 | 43.0 | 30 | $7.9 \times 10^{7}$ |
| Toner 9 | 2 | 1.4 | 3.1 | 5.7 | 4 | $3.4 \times 10^{11}$ |

$\alpha = (\in_H - \in_L)/0.75 + \log(f)$ and
$\beta = \in_B/0.75 + \log(f)$.

Five parts of toner composition 1 prepared as above was admixed with a 100 parts of Ricoh silicone coat carriers to form image developer materials 1, which is shown as Example 1 in Table 3. The image developer material 1 was then incorporated into a Ricoh digital copy apparatus commercially available as the IMAGIO MF200®, and tested up to 10,000 copies using a test chart which carries 6% of picture image portions thereon.

In a similar manner, image developer materials 2 through 9 of the present invention were formed using the toner compositions 2 through 9, respectively, and were subsequently tested as above.

Image quality was also evaluated following the test copying as well as the initial state as follows.

Narrow Line Image Reproducibility

A test pattern having 1 dot staggered lattice pattern was outputted with a dot density of 600 dot/inch and 150 line/inch in both main and secondary directions. Image quality was visually evaluated in terms of line disconnection or blurring, and results are shown in Table 3 in three grades as follows.

◎ Excellent, ○ satisfactory,

Δ medium and X unsatisfactory.

Resolution

In similar manner as above, a three grades evaluation was carried out also for the resolution of the outputted images. The results are also shown in Table 3.

Transfer Property

Images of a character test chart was outputted, and image quality was visually evaluated in terms of line disconnection or missing dots, and results are shown in Table 3.

Amount of Charge and Image Density

An amount of toner charge was measured following the removal of the developer powders from the developing unit of the copy apparatus using the known blow-off method. Image density was also measured with a McBeth reflective densitometer. Results from the measurements are also shown in Table 3

TABLE 3

| Developer material | Toner composition No. | Image density: Initial | Image density: After $10^4$ copies | Amount of charge μC/gr: Initial | Amount of charge μC/gr: After $10^4$ copies |
|---|---|---|---|---|---|
| Ex. 1 | Toner 1 | 158 | 112 | −19 | −24 |
| Ex. 2 | Toner 2 | 139 | 091 | −21 | −24 |
| Ex. 3 | Toner 3 | 122 | 104 | −22 | −25 |
| Ex. 4 | Toner 4 | 141 | 162 | −20 | −19 |
| Ex. 5 | Toner 5 | 148 | 113 | −20 | −24 |
| Ex. 6 | Toner 6 | 142 | 121 | −21 | −23 |
| Ex. 7 | Toner 7 | 141 | 135 | −21 | −22 |
| Comp. Ex. 1 | Toner 8 | 065 | — | −4 | — |
| Comp. Ex. 2 | Toner 9 | 076 | — | −29 | — |

| Developer material | Reproducibility of minute lines | Resolution | Transfer capability | |
|---|---|---|---|---|
| Ex. 1 | ○ | Δ | ○ | |
| Ex. 2 | ○ | Δ | ○ | |
| Ex. 3 | ○ | ○ | ○ | |
| Ex. 4 | ○ | Δ | ○ | |
| Ex. 5 | ○ | ○ | Δ | |
| Ex. 6 | ○ | ○ | Δ | |
| Ex. 7 | ◎ | ◎ | ◎ | Image density is high and durability is excellent. |
| Comp. Ex. 1 | X | X | X | Charge amount is low and transfer capability is unsatisfactory. |
| Comp. Ex. 2 | Δ | X | ○ | Numerous spots appeared around minute lines and characters, and resolution is unsatisfactory. |

The results described hereinabove clearly indicate the electrophotographic toner composition of the present invention exhibit such characteristics as excellent durable capabilities of electrostatic charging and electrophotographic image formation with a high and persistent image density.

This application is based on Japanese Patent Application No. 9-309433, which was filed in the Japanese Patent Office on Oct. 27, 1997, and which is herein incorporated by reference in its entirety.

Obviously, additional modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An electrophotographic toner composition comprising toner particles containing a coloring agent, a binder resin and at least two kinds of additives, wherein said at least two kinds of additives satisfy a relationship, $$4<((\in_H-\in_L)/0.75+\log(f))<16,$$

in which f is 1000, and $\in_H$ and $\in_L$ are respectively highest and lowest values of dielectric constants at 1 kHz for said at least two kinds of additives, wherein each of said at least two kinds of additives comprises particles of hydrophobic titanium oxide and particles of hydrophobic silicon oxide; and wherein a surface of said particles of hydrophobic titanium oxide is substantially coated with an alkyl alkoxysilane and/or compound represented by a general formula, $$(C_nF_{2n+1})_p—Si—(O—C_mF_{2m+1})_{4-p},$$

or with polycondensation products thereof, in which n and m are each a positive integer equal to or larger than 4.

2. An electrophotographic toner composition comprising toner particles containing a coloring agent, a binder resin and at least two kinds of additives, wherein said toner composition satisfies a relationship, $$5<(\in_B/0.75+\log(f))<11,$$

in which f is a 1000, and $\in_B$ is a dielectric constant at 1 kHz of said electrophotographic toner composition, wherein each of said at least two kinds of additives comprises particles of hydrophobic titanium oxide and particles of hydrophobic silicon oxide; and wherein a surface of said particles of hydrophobic titanium oxide is substantially coated with an alkyl alkoxysilane and/or compound represented by a general formula, $$(C_nF_{2n+1})_p—Si—(O—C_mF_{2m+1})_{4-p},$$

or with polycondensation products thereof, in which n and m are each a positive integer equal to or larger than 4.

3. The electrophotographic toner composition according to claim 2, wherein each of said at least two kinds of additives has a dielectric constant at 1 kHz of from 2 to 6.

4. The electrophotographic toner composition according to claim 1, wherein each of said at least two kinds of additives has a volume resistivity of from $1\times10^8$ to $1\times10^{10}$ ohm·cm.

5. The electrophotographic toner composition according to claim 1, wherein each of said at least two kinds of additives has a ratio Dn/Dv equal to or less than 2, where Dn and Dv are number average and volume average particle sizes, respectively.

6. The electrophotographic toner composition according to claim 1, wherein said electrophotographic toner composition contains from 0.1 to 2% by weight of each of said at least two kinds of additives; and a number average particle size of each of said at least two kinds of additives is from 5 to 10 microns.

7. The electrophotographic toner composition according to claim 3, wherein a surface of said particles of hydrophobic titanium oxide is substantially coated with a compound represented by a general formula, $$(C_nF_{2n+1})_p—Si—(O—C_mF_{2m+1})_{4-p},$$

or with polycondensation products thereof, in which n and m are each a positive integer equal to or larger than 4.

8. A method for forming an electrophotographic image comprising:

a charging process in which a carrier for a latent image is charged;

a latent image forming process in which an electrostatic latent image is formed on the charged carrier for a latent image; and a developing process in which the electrostatic latent image is developed with an electrophotographic toner composition, wherein said electrophotographic toner composition comprises toner particles containing a coloring agent, a binder resin and at least two kinds of additives, in which said at least two kinds of additives satisfy a relationship, $$4<((\in_H-\in_L)/0.75+\log(f))<16,$$

in which f is a 1000, and $\in_H$ and $\in_L$ are respectively highest and lowest values of dielectric constants at 1 kHz for said at least two kinds of additives;

each of said at least two kinds of additives comprises particles of hydrophobic titanium oxide and particles of hydrophobic silicon oxide, and each of said at least two kinds of additives has a dielectric constant at 1 kHz of from 2 to 6;

a surface of said particles of hydrophobic titanium oxide is substantially coated with compounds represented by a general formula, $$(C_nF_{2n+1})_p—Si—(O—C_mF_{2m+1})_{4-p},$$

or with polycondensation products thereof, in which n and m are each a positive integer equal to or larger than 4;

each of said at least two kind of additives has a volume resistivity of from $1\times10^8$ to $1\times10^{10}$ ohm·cm and a ratio Dn/Dv equal to or less than 2, in which Dn and Dv are number average and volume average particle sizes, respectively;

said electrophotographic toner composition contains from 0.1 to 2% by weight of each of said at least two kinds of additives; and a number average particle size of each of said at least two kinds of additives is from 5 to 10 microns.

9. A method for forming an electrophotographic image comprising:

a charging process in which a carrier for a latent image is charged;

a latent image forming process in which an electrostatic latent image is formed on the charged carrier for a latent image; and a developing process in which the electrostatic latent image is developed with an electrophotographic toner composition, wherein said electrophotographic toner composition comprises toner particles containing a coloring agent, a binder resin and at least two kinds of additives, in which said toner composition satisfies a relationship $$5<(\in_B/0.75+\log(f))<11,$$

in which f is a 1000, and $\in_B$ is a dielectric constant at 1 kHz for said toner composition, wherein each of said at least two kinds of additives comprises particles of hydrophobic titanium oxide and particles of hydrophobic silicon oxide; and wherein a surface of said particles of hydrophobic titanium oxide is substantially coated with an alkyl alkoxysilane and/or compound represented by a general formula, $$(C_nF_{2n+1})_p—Si—(O—C_mF_{2m+1})_{4-p},$$

or with polycondensation products thereof, in which n and m are each a positive integer equal to or larger than 4.

* * * * *